US006535698B2

(12) United States Patent
Horikoshi

(10) Patent No.: US 6,535,698 B2
(45) Date of Patent: Mar. 18, 2003

(54) RECORDING MEDIUM CONVEYANCE METHOD AND APPARATUS FOR AN IMAGE FORMING APPARATUS, AND AN IMAGE FORMING APPARATUS THEREOF

(75) Inventor: Toshihiko Horikoshi, Mishima (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 09/792,427

(22) Filed: Feb. 23, 2001

(65) Prior Publication Data

US 2001/0033753 A1 Oct. 25, 2001

(30) Foreign Application Priority Data

Feb. 24, 2000 (JP) ..... 2000-047416

(51) Int. Cl.[7] ..... G03G 15/00
(52) U.S. Cl. ..... 399/16; 399/21
(58) Field of Search ..... 399/16, 18, 21

(56) References Cited

U.S. PATENT DOCUMENTS 4,808,998 A * 2/1989 Miyawaki ..... 399/21
5,550,614 A * 8/1996 Motoyama ..... 399/18
5,729,788 A * 3/1998 Hirohashi et al. ..... 399/66
5,799,226 A * 8/1998 Shigeta et al. ..... 399/66

FOREIGN PATENT DOCUMENTS

JP 8-166746 * 6/1996

* cited by examiner

*Primary Examiner*—Quana M. Grainger
(74) *Attorney, Agent, or Firm*—Rossi & Associates

(57) ABSTRACT

The present invention provides a recording medium conveyance method and apparatus, which can prevent a properly conveyed recording medium from being determined as jamming to thereby avoid an unnecessary operation of dealing with a jam. A timing measuring means 102 measures timing in which the recording medium passes a predetermined location downstream of a separation electrifier, which separates a moving recording medium from a photosensitive drum, in accordance with information acquired by a post-separation sensor, which detects the recording medium at the predetermined location downstream of the separation electrifier. A passage timing storage means 103 stores passage timing information acquired by the timing measuring means, a mean value calculating means 104 calculates a mean value of the measured timing in accordance with the passage timing information stored by the passage timing storage means 103, and a control unit 105 executes a control in such a manner as to perform a predetermined operation in accordance with information acquired by the mean value calculating means 104.

33 Claims, 10 Drawing Sheets

RECORDING MEDIUM CONVEYANCE METHOD AND APPARATUS FOR AN IMAGE FORMING APPARATUS, AND AN IMAGE FORMING APPARATUS THEREOF

BACKGROUND OF THE INVENTION

1. Field of the Invention

The present invention relates to a recording medium conveyance method and apparatus applied to image forming apparatuses such as copying machines, printers, facsimiles and inkjet printers, and a storage medium that contains a control program for use in controlling the recording medium conveyance apparatus.

2. Description of Related Art

FIG. 8 is a schematic diagram showing the internal structure of a conventional image forming apparatus (e.g., a copying machine, a printer, a facsimile and an inkjet printer). In FIG. 8, reference numeral 801 denotes a photosensitive drum, which forms a toner image from a latent image. Reference numeral 802 denotes a laser scanner, which depicts a latent image on the photosensitive drum 801, and 803 a tone developer, which puts toner on the latent image on the photosensitive drum 801. Reference numeral 804 denotes a feeding roller 804, which feeds a recording medium (e.g., recording paper) P, described later. Reference numeral 805 denotes a transfer part, which transfers an image onto the recording medium P and separates the recording medium P from the photosensitive drum 801 (recording medium separating part), and 806 a toner fixing part, which fixes the toner on the recording medium P. Reference numeral 807 denotes a post-separation sensor, which senses a separation jam, 808 a reader part, which reads an image, and 809 a pair of resist rollers, which stops and feeds the recording medium P according to a control sequence before the recording medium P is fed to the transfer part 805. Reference numeral 810 denotes a transfer electrifier, which transfers a toner image on the photosensitive drum 801, 811 a separation electrifier, which separates the recording medium P from the photosensitive drum 801, and 812 a cleaning means, which removes the toner residing on the photosensitive drum 801. Symbol P designates recording paper as the recording medium.

FIG. 9 is a schematic diagram showing the internal structure of parts around a photosensitive drum of a conventional image forming apparatus. In FIG. 9, reference numeral 901 denotes a photosensitive drum as an image carrier, which forms a toner image from a latent image, and 902 a part, which transfers an image on a recording medium (e.g., recording paper) 906, described later, and then separates the recording medium 906 from the photosensitive drum 901. Reference numeral 903 denotes a cleaning means that removes toner residing on the photosensitive drum 901, and 904 a separation electrifier, which separates the recording medium 906 from the photosensitive drum 901. Reference numeral 905 denotes a post-separation sensor, which senses a separation jam, and 906 the recording medium. FIG. 9 shows a state wherein the recording medium 906, which is poorly separated from the photosensitive drum 901, is passing the lower side of the photosensitive drum 901.

FIG. 10 is a schematic diagram showing an input from the outside of a conventional image forming apparatus. In FIG. 10, reference numeral 1001 denotes a conveyance belt, which conveys a recording medium by electrostatic absorption, and 1001*a* and 1001*b* belt driving rollers for driving the conveyance belt 1001. Reference numeral 1002 denotes an absorption electrifier for absorbing the recording medium onto the conveyance belt 1001, 1003 a separation electrifier, which separates the recording medium from the conveyance belt 1001, and 1004 a post-separation sensor for detecting a separation jam. Reference numeral 1005 denotes a pair of resist rollers, which stops and feeds the recording medium before the recording medium is fed to a transfer part, and 1006 a photosensitive drum as an image carrier, which forms a toner image describing a latent image.

FIG. 11 is a diagram showing a conventional method of detecting a separation delay jam. In FIG. 11, reference numeral 1101 denotes a resist clutch signal that is an actuating signal from a resist clutch, which operates the pair of resist rollers (denoted by 809 in FIG. 8 and 1005 in FIG. 10). Reference numeral 1102 denotes a sensor signal from the post-separation sensor (denoted by 807 in FIG. 8, 905 in FIG. 10 and 1004 in FIG. 10). Reference numeral 1103 denotes a point in time where the resist clutch is operated. Reference numeral 1104 denotes a jam detection timing. Reference numeral 1105 indicates that a sensor signal 1102 is High, and 1106 indicates that a sensor signal 1102 is Low.

There will now be given some examples of separation devices provided in an image forming apparatus such as a copying machine, a printer, a facsimile and an inkjet printer, which separate a recording medium such as paper, an OHP, a board and a cloth. If the image forming apparatus is a copying machine and the recording medium is paper, a first example of the separation devices is a device that transfers images depicted on the photosensitive drum 801 as the image carrier onto sheets of paper, which are conveyed on a sheet-by-sheet basis from the feeding part 804 in FIG. 8, and then electrostatically separates the paper from the photosensitive drum 801.

A second example of the separation devices is a device that is provided in a copying machine having the conveyance belt 1001 in FIG. 10 and applies an electric current to the absorption electrifier 1002, absorbs the paper onto the conveyance belt 1001, transfers an image depicted the photosensitive drum 1006 as the image carrier onto the paper by the transfer electrifier 1007, separates the paper from the photosensitive drum 1006 and then separates the paper from the conveyance belt 1001 by the separation electrifier 1003.

If the image forming apparatus is an inkjet printer, an example of the separation devices is a device that separates the recording medium from a head member, which forms an image by jetting ink.

Referring next to FIG. 8, a brief description will be given of the entire operation of the image forming apparatus having the separation device as the above-mentioned first example.

In FIG. 8, a laser beam emitted from the laser scanner 802 is irradiated onto the photosensitive drum 801, which is rotating clockwise as viewed in the figure. This forms an electrostatic latent image on the photosensitive drum 801, and the tone developer 803 visualizes the electrostatic latent image. The laser scanner 802 emits a laser beam according to an original image read by the reader part 808. On the other hand, sheets of the recording medium P, which are stacked in a recording medium cassette, not shown, are fed from the cassette. The feeding roller 804, which is rotating counterclockwise as viewed in the figure, sequentially feeds the sheets of the recording medium P stacked in the recording medium cassette from the top one on a sheet-by-sheet basis. The recording medium P fed from the recording medium cassette is sent to the pair of resist rollers 809, which are not rotating. Each sheet of the recording medium P stops moving when it abuts against a nip of the pair of resist rollers 809 and forms a predetermined amount of loop. This corrects oblique movement of the recording medium P, so that an image can be recorded on the recording medium which is in a correct position. The recording medium P, after having been corrected from the oblique position, is conveyed to the transfer part 805 between the photosensitive drum 801 and the transfer electrifier 810 by the pair of resist rollers 809 which start rotation in predetermined timing. While the recording medium P is passing the transfer part 805, the transfer electrifier 810 transfers a toner image onto the photosensitive drum 801. During the transfer of the toner image, the recording medium P is electrostatically absorbed onto the photosensitive drum 801, but is separated from the photosensitive drum 801 by the separation electrifier 811. The recording medium P, which has been properly separated from the photosensitive drum 801, is guided to reach the post-separation sensor 807 in proper timing. The conveyed recording medium P is then sent to the toner fixing part 806, which heats and pressurizes the recording medium P to fix the toner image which has been unfixed. Upon completion of the fixing process, the recording medium P is discharged onto a discharge tray, not shown, outside the image forming apparatus.

A detailed description will now be given of the operation of the recording medium separating part. After the image depicted the photosensitive drum 801 is transferred onto the recording medium P by the image transfer part 805, an electric current is applied to the separation electrifier 811 to separate the recording medium P from the photosensitive drum 801. If this separation is not well done, the recording medium P moves in a state held in contact with the photosensitive drum 801, and this may result in damage to the cleaning means 812, etc. on the photosensitive drum 801.

Any of the separation devices mentioned above has the possiblity of damage to a part or parts inside of the apparatus body if the recording medium moves in in a state held in contact with a non-contact body (e.g., the photosensitive drum 801).

To eliminate this disadvantage, conventionally, a recording medium conveyance part after the recording medium separating part has a recording medium detecting means 807, and whether the sensor output signal indicating a state of the recording medium from the post-separation sensor (807 in FIG. 8, 905 in FIG. 9 and 1004 in FIG. 10) is High (1105 in FIG. 11) or Low (1106 in FIG. 11) is determined upon the passage of a predetermined period of time which was set at a designing stage (in the image forming apparatus in FIG. 8 for example, 500 ms after the generation of an actuating signal from the resist clutch for actuating the pair of resist rollers 809 (the pair of resist rollers 1005 in FIG. 10), which temporarily stop the recording medium P fed sheet by sheet from the feeding roller 804, start rotating after the generation of an image formation signal and feed the recording medium P to the transfer part) (1101, 1103 and 1104 in FIG. 11). If the output signal from the post-separation sensor is High, the recording medium P is determined as jamming and then the recording medium conveying part is stopped (1105 in FIG. 11).

A current value applied to a separation electrifier member (the separation electrifier 811 in FIG. 8 and the separation electrifier 904 in FIG. 9) for use in separating the recording medium from the image carrier is constant in an atmosphere (i.e., moisture and temperature) in which the image forming apparatus is placed, although conventionally there was an image forming apparatus which determines the atmosphere and change the current value according to the atmosphere.

Although conventionally there was a device for cleaning the separation electrifier, which is used to separate the recording medium from the image carrier, a cleaning member of that device is regularly operated, e.g., whenever a predetermined number of sheets of the recording medium have passed the device or when a predetermined period of time has passed after a power supply is turned on.

In the prior art, however, as described above, the detection of a jam at the recording medium separating part is carried out by determining whether the output signal from the post-separation sensor (807 in FIG. 8, 905 in FIG. 9 and 1004 in FIG. 10) is High (1105 in FIG. 11) or Low (1106 in FIG. 11) after the lapse of a predetermined period of time set at the designing stage (e.g., 500 ms after the generation of the resist clutch actuating signal) (1101, 1103 and 1104 in FIG. 11). For example, High indicates the presence of the recording medium, and the recording medium is determined as jamming if the output signal from the post-separation sensor is High. If the output signal is Low, the recording medium is not determined as jamming.

Since the jam detection timing is constant in the above case, the recording medium passing after the jam detection timing is indiscriminately determined as jamming even if there is no problem in respect of the separation performance. This causes temporal and economic damage to a user since he or she is required to spend much time dealing with the jam and pay extra copying fees.

An explanation will now be given of timing in which the recording medium passes through the post-separation sensor (807 in FIG. 8, 905 in FIG. 9 and 1004 in FIG. 10). If the number of passing sheets of the recording medium is increased, it becomes impossible to apply a proper separation current to the recording medium due to dirt, etc. of the separation electrifier member. For example, the recording medium 906 passes through the separation part as shown in FIG. 9 in a fashion being wound around the image carrier (the photosensitive drum 901). Therefore, as shown in a graph of FIG. 12 wherein the abscissa represents passage timing and the ordinate represents the number of passing sheets of recording medium, there is such a tendency that minimum passage timing Tmin becomes smaller, maximum passage timing Tmax becomes larger, hence mean passage timing Tmean is delayed, and a standard deviation $\sigma$ of the passage timing becomes larger, as will be learned from a comparison between a line 1201 and a line 1202. Thus, if the jam timing Tjam is fixed, a further increase in the number of sheets of recording medium may make it impossible for the recording medium to pass through the post-separation sensor before the jam timing Tjam. In this case, even a properly separated sheet of recording medium is determined as jamming.

Further, since the current value applied to the separation electrifier is almost constant in the atmosphere in which the apparatus is placed, the current value may be unsuitable for separating the recording medium from the image carrier or the conveyance belt depending upon the state of the image carrier (the photosensitive drum 801 in FIG. 8) or the conveyance belt (1001 in FIG. 10). In this case, the recording medium cannot be separated satisfactorily, and this results in phenomena such as a poor image and jamming.

SUMMARY OF THE INVENTION

It is therefore a first object of the present invention to provide a recording medium conveyance method and apparatus, which can prevent a properly conveyed recording medium from being determined as jamming to thereby avoid an unnecessary operation of dealing with a jam and can further prevent degradation in the separation performance of an electric separation means for the recording medium.

It is a second object of the present invention to provide a storage medium that contains a control program for controlling the above-mentioned recording medium conveyance apparatus of the present invention.

To attain the first object, in a first aspect of the present invention, there is provided a recording medium conveyance method for conveying a recording medium, comprising a recording medium separation step of separating a moving recording medium in contact with a member on the recording medium, from the member, a recording medium detecting step of detecting the recording medium at a predetermined location downstream of the recording medium separation step, a timing measuring step of measuring timing in which the recording medium passes the predetermined location downstream of the recording medium separation step in accordance with passage timing information acquired in the recording medium detecting step, a passage timing storing step of storing the passage timing information acquired in the timing measuring step, a statistic calculation step of executing a statistic calculation to acquire statistically calculated passage timing information in accordance with the passage timing information stored in the passage timing storing step, and a control step of executing a control in such a manner as to perform a predetermined operation in accordance with the statistically calculated passage timing information acquired in the statistic calculation step.

Typically, the recording medium is paper.

Preferably, the statistic calculation step comprises calculating a mean value of the measured timing.

Also preferably, the statistic calculation step comprises calculating a standard deviation of the measured timing.

Preferably, the statistic calculation step comprises calculating maximum passage timing of the recording medium.

Also preferably, the statistic calculation step comprises calculating minimum passage timing of the recording medium.

Further preferably, the statistic calculation step comprises calculating percentage of frequency of passage of the recording medium through the predetermined location in timing other than predetermined timing.

More preferably, the statistic calculation step comprises calculating at least two of a mean value of the measured timing, a standard deviation of the measured timing, maximum passage timing of the recording medium, and minimum passage timing of the recording medium.

Preferably, the control step comprises controlling timing of detecting a jam of the recording medium.

Also preferably, the control step comprises giving a warning of a change in the statistically calculated passage timing information.

The recording medium conveyance method according to the first aspect may further comprise a separation electrifying member cleaning step of cleaning a separation electrifying member for use in the recording medium separation step, and a second control step of controlling the separation electrifying member cleaning step in accordance with the statistically calculated passage timing information acquired in the statistic calculation step.

To attain the first object, in a second aspect of the present invention, there is provided a recording medium conveyance apparatus for conveying a recording medium, comprising recording medium separation means for separating a moving recording medium in contact with a member on the recording medium, from the member, recording medium detecting means for detecting the recording medium at a predetermined location downstream of the recording medium separation means, timing measuring means for measuring timing in which the recording medium passes the predetermined location downstream of the recording medium separation means in accordance with passage timing information acquired by the recording medium detecting means, passage timing storing means for storing the passage timing information acquired by the timing measuring means, statistic calculation means for executing a statistic calculation to acquire statistically calculated passage timing information in accordance with the passage timing information stored by the passage timing storing means, and control means for executing a control in such a manner as to perform a predetermined operation in accordance with the statistically calculated passage timing information acquired by the statistic calculation means.

To attain the first object, in a third aspect of the present invention, there is provided an image forming apparatus comprising transfer means for transferring a toner image carried on an image carrier, onto a recording medium, separation means for separating the recording medium from the image carrier, detection means for detecting the recording medium separated by the separation means, and control means for controlling the separation means in accordance with a detected result of the detecting means.

Preferably, in the image forming apparatus according to the third aspect, the control means controls an electric current applied to the separation means.

Also preferably, the image forming apparatus according to the third aspect further comprises storage means for storing timing in which the recording medium is detected by the detection means.

To attain the first object, in a fourth aspect of the present invention, there is provided an image forming apparatus comprising transfer means for transferring a toner image carried on an image carrier, onto a recording medium, separation means for separating the recording medium from the image carrier, detection means for detecting the recording medium separated by the separation means, determination means for determining a jam in accordance with a result of the detection by the detection means, and control means for controlling a threshold value for determination of the jam by the determination means in accordance with the result of the detection by the detection means.

Preferably, the image forming apparatus according to the fourth aspect further comprises storage means for storing timing in which the recording medium is detected by the detection means.

To attain the first object, in a fifth aspect of the present invention, there is provided an image forming apparatus comprising transfer means for transferring a toner image carried on an image carrier, onto a recording medium, separation means for separating the recording medium from the image carrier, detection means for detecting the recording medium separated by the separation means, and cleaning means for cleaning the separation means in accordance with a result of the detection by the detection means.

Preferably, the image forming apparatus according to teh fifth aspect further comprises storage means for storing timing in which the recording medium is detected by the detection means.

To attain the second object, in a sixth aspect of the present invention, there is provided a storage medium storing a computer readable program for controlling a recording medium conveyance apparatus for conveying a recording medium, the program comprising a program code for causing a computer to execute a recording medium conveyance method comprising a recording medium separation step of separating a moving recording medium in contact with a member on the recording medium, from the member, a recording medium detecting step of detecting the recording medium at a predetermined location downstream of the recording medium separation step, a timing measuring step of measuring timing in which the recording medium passes the predetermined location downstream of the recording medium separation step in accordance with passage timing information acquired in the recording medium detecting step, a passage timing storing step of storing the passage timing information acquired in the timing measuring step, a statistic calculation step of executing a statistic calculation to acquire statistically calculated passage timing information in accordance with the passage timing information stored in the passage timing storing step, and a control step of executing a control in such a manner as to perform a predetermined operation in accordance with the statistically calculated passage timing information acquired in the statistic calculation step.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described hereinbelow with reference to the accompanying drawings showing preferred embodiments thereof.

(First embodiment)

A first embodiment of the present invention will now be described with reference to FIGS. 1 and 2.

Figure 8:
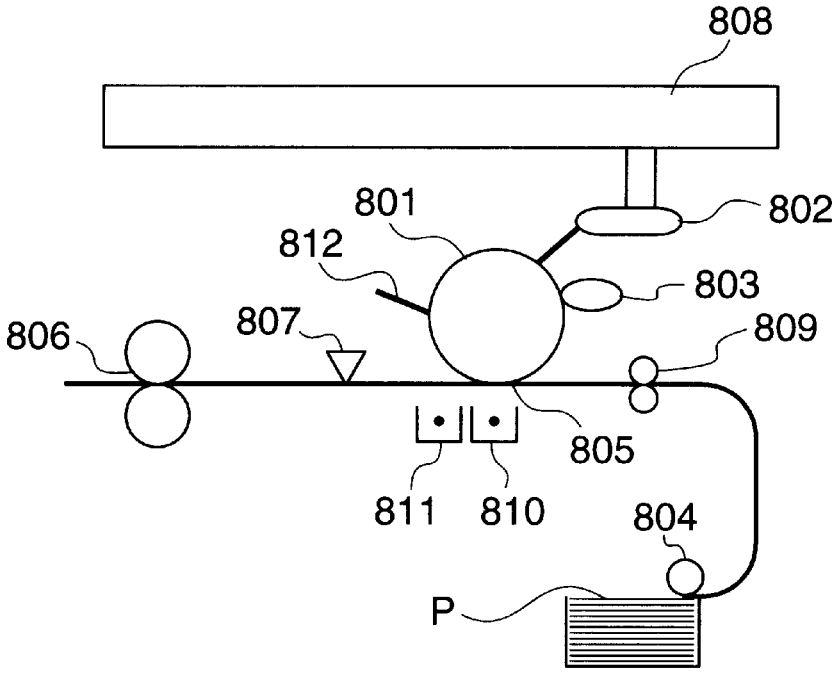
FIG. 8 PRIOR ART
FIG. 8 is a schematic diagram showing the internal structure of a conventional image forming apparatus.
Figure 9:
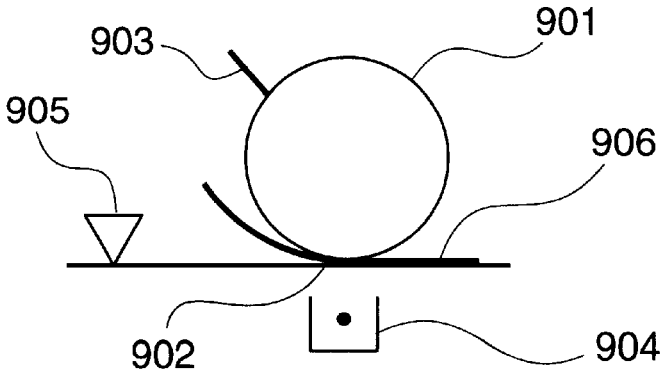
FIG. 9 PRIOR ART
FIG. 9 is a schematic diagram showing the construction of parts around a photosensitive drum in a conventional image forming apparatus.
Figure 10:
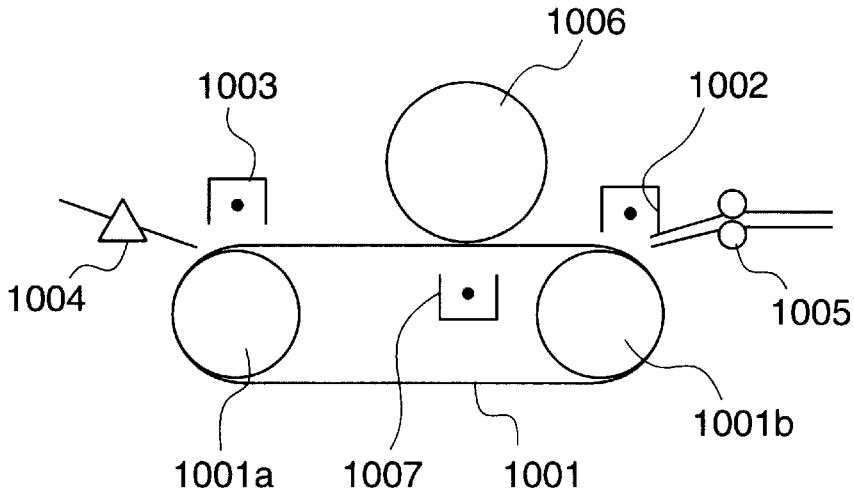
FIG. 10 PRIOR ART
FIG. 10 is a schematic diagram showing an input from the outside of a conventional image forming apparatus.
Figure 11:
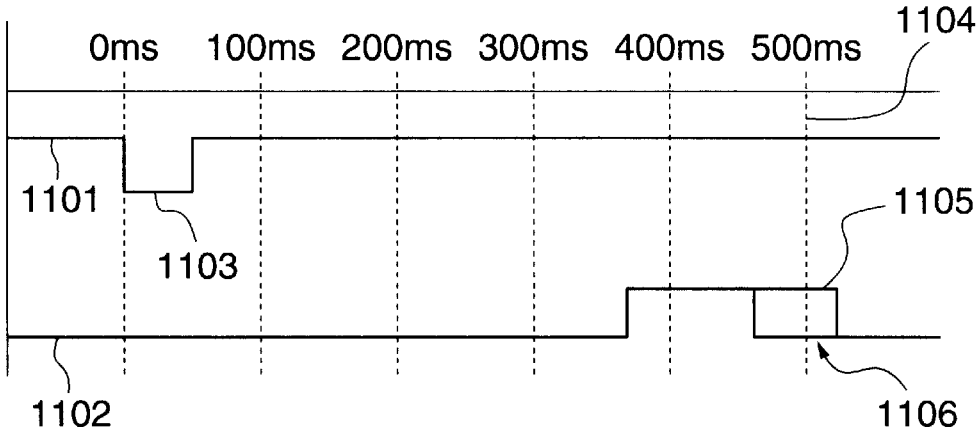
FIG. 11 PRIOR ART
FIG. 11 is a diagram showing a conventional method of detecting a recording medium separation delay jam.
Figure 12:
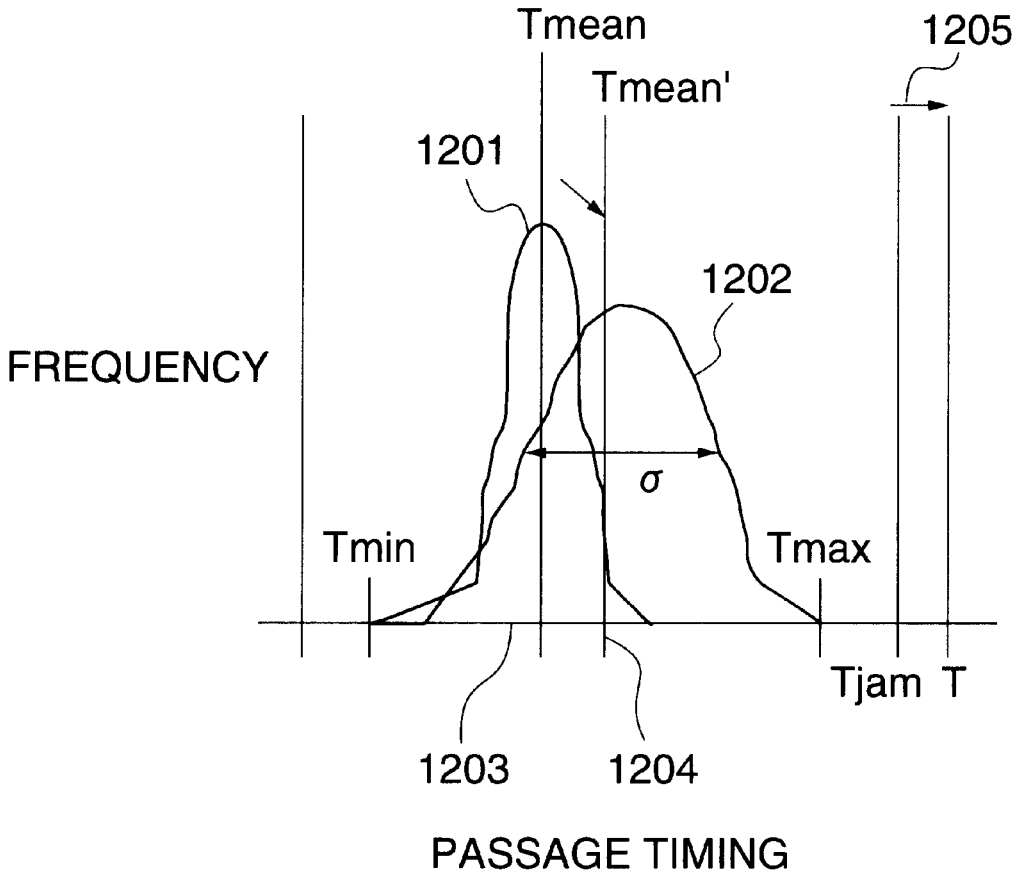
FIG. 12 PRIOR ART
FIG. 12 is a diagram showing the distribution of the number of sheets of recording medium (the frequency of passage) passing a post-separation sensor in conventional recording medium passage timing.

An image forming apparatus provided with a recording medium conveyance apparatus of the present embodiment has the same basic construction as the prior art in FIGS. 8–10, and thus, FIGS. 8–10 will be used to explain the first embodiment if necessary. FIG. 12 showing the prior art is used to explain the relationship between the frequency of passage of the recording medium through a post-separation sensor and passage timing.

An image forming apparatus, which transfers an image formed on a photosensitive drum (801 in FIG. 8, 903 in FIG. 9 and 1006 in FIG. 9) as an image carrier onto a recording medium (P in FIG. 8 and 906 in FIG. 9) by a transfer part (805 in FIG. 8), has a post-separation sensor (807 in FIG. 8, 905 in FIG. 9 and 1004 in FIG. 10) arranged behind the photosensitive drum and measures passage timing T of the recording medium that passes through the post-separation sensor.

FIG. 12 is a graph in which the ordinate represents the frequency of passage of the recording medium (the number of passing sheets of recording medium) through the post-separation sensor and the abscissa represents passage timing. As is clear from FIG. 12, the passage timing shifts with a tendency to delay as indicated by a line 1201 and a line 1202 as a larger number of sheets of the recording medium pass through the post-separation sensor.

Suppose that a reference signal is a mean value of the passing timing and a control operation is jam detection timing. The reference signal, i.e., the mean value (Tmean) 1203 for a predetermined initial number (e.g., 500) of sheets of recording medium is calculated, and thereafter, a mean value (Tmean') 1204 for a predetermined number of sheets of recording medium is sequentially calculated. If the calculated mean value Tmean' for the predetermined number of sheets of recording medium is larger than a predetermined value, the control operation, i.e., the jam detection timing Tjam is delayed by a predetermined period of time (e.g., 5 ms) (1205 in FIG. 12).

If, however, the conveyance of the recording medium is delayed, the jam detection timing may be delayed infinitely. If the recording medium 904 moves while it is held in contact with the photosensitive drum 901 as shown in FIG. 9, the recording medium 906 is conveyed to the cleaning means 903. This may result in damage to the cleaning means 903.

To solve this problem, maximum jam detection timing (Tbreak) is set in advance. If the jam detection timing is larger, i.e., later than the maximum jam detection timing Tbreak, information indicating an error is displayed.

Normally, the maximum jam detection timing Tbreak is determined by the following division formula: (the distance between the cleaning means and the recording medium separating part)÷(conveyance speed of the recording medium). If, however, a member which may be broken or damaged is placed between the recording medium separating part and the cleaning means, the jam detection timing Tbreak is calculated according to the distance between the recording medium separating part and the member.

Figure 1:
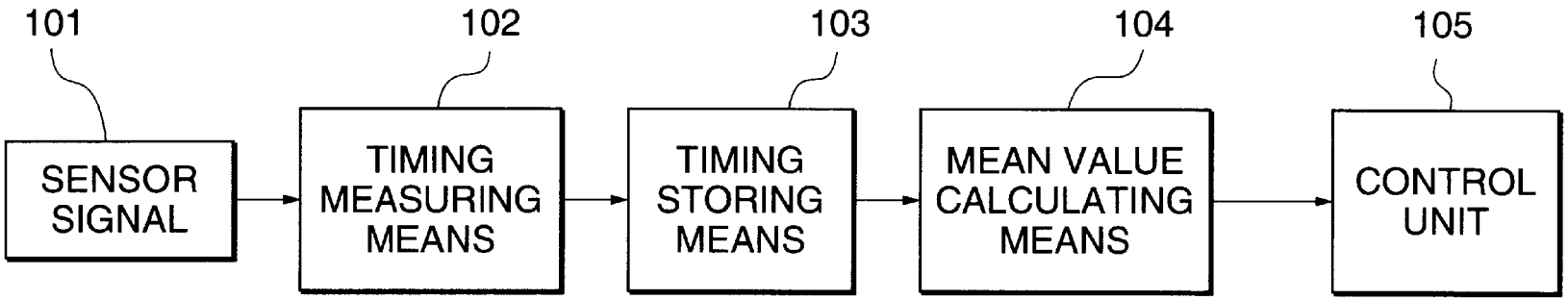
FIG. 1 is a block diagram showing the construction of a control system in a recording medium conveyance apparatus according to a first embodiment of the present invention.

FIG. 1 is a block diagram showing the construction of a control system in the recording medium conveyance apparatus according to the present embodiment. In FIG. 1, reference numeral 101 denotes a sensor signal, which is generated by the post-separation sensor. Reference numeral 102 denotes a timing measuring means, which measures sensor signal generation timing according to the sensor signal 101. Reference numeral 103 denotes a timing storing means, which stores the sensor signal generation timing measured by the timing measuring means 102. Reference numeral 104 denotes a mean value calculating means, which calculates a mean value of the measured timing for an arbitrary number of sheets of recording medium. Reference numeral 105 denotes a control unit, which controls the entire control system.

In the control system that is constructed in the above-mentioned manner, the timing measuring means 102 measures the sensor signal generation timing according to the sensor signal 101, the timing storing means 103 stores the measured sensor signal generation timing, the mean value calculating means 104 calculates the mean value for an arbitrary number of sheets of recording medium, and the control unit 105 determines whether there is a predetermined variation from the initial mean value and delays the jam detection timing by a predetermined period of time (e.g., 5 ms) if there is such a variation. Furthermore, it is determined whether the jam detection timing is larger, i.e. later than a predetermined value (Tbreak). If yes, the control unit 105 displays information indicating an error.

Figure 2:
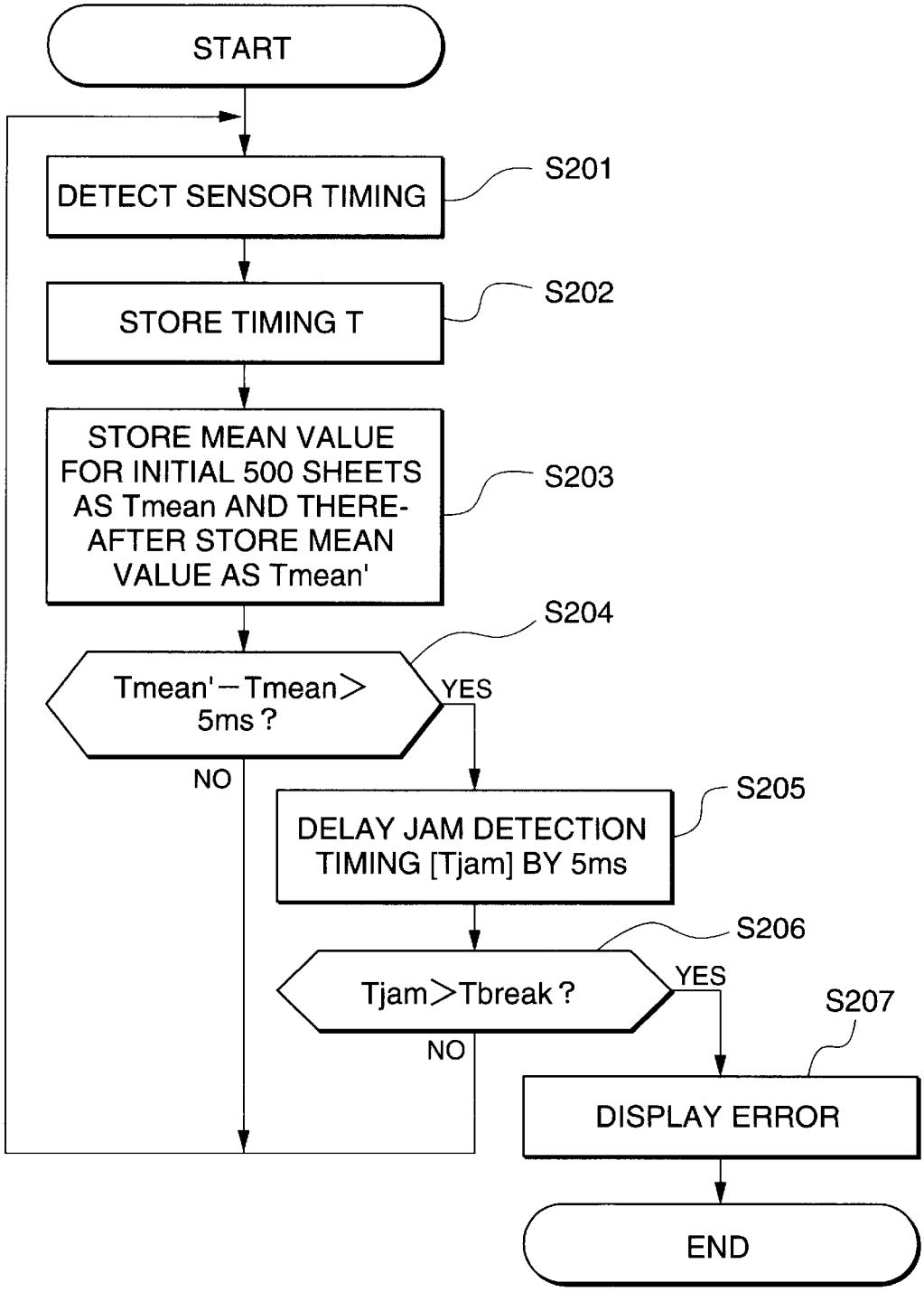
FIG. 2 is a flow chart showing a flow of operation of the control system in the recording medium conveyance apparatus according to the first embodiment.

FIG. 2 is a flow chart showing a flow of operation in the case where a parameter for calculating the mean value is 500 and the condition for changing the jam detection timing is Tmean'−Tmean>5 ms.

As shown in FIG. 2, the timing measuring means 102 measures the sensor signal generation timing according to the sensor signal 101 in a step S201. In a next step S202, the timing storing means 103 stores the sensor signal generation timing T measured in the step S201. In a next step S203, a mean value of the measured timing for 500 sheets of recording medium fed at the initial stage is stored as Tmean, and thereafter, the mean value is stored as Tmean'. In a next step S204, the control unit 105 determines whether a difference between Tmean' and Tmean is larger than 5 ms (Tmean'−Tmean>5 ms). If no in the step S204, the process returns to the step S201, and if yes, the process goes to a step S205.

In the step S205, the control unit 105 delays the jam detection timing Tjam by 5 ms. In a next step S206, the control unit 105 determines whether the jam detection timing Tjam in the step S205 is larger than a preset value (Tbreak) (Tjam>Tbreak). If yes, the process is finished after the control unit 105 controls a display means in a step S207 to display information indicating that there is an error. If no, the process returns to the step S201.

According to the present embodiment, the control is executed according to the reference signal for a predetermined number of sheets of recording medium fed at the initial stage. The control, however, may also be executed according to a reference signal obtained at any stage during the passage of the recording medium.

As shown in FIG. 12, it is known that the passage of a large number of sheets of recording medium changes the mean value Tmean, the standard deviation σ, the maximum value Tmax, the minimum value Tmin, and the maximum value Tmax−the minimum value Tmin. Therefore, the jam detection timing may be changed if a certain change is detected in the statistic calculation in which the reference signal is not only the mean value Tmean but also the standard deviation s, the maximum value Tmax, the minimum value Tmin, a combination thereof or the like.

According to the present embodiment, the jam detection timing is delayed in the control operation in order to prevent properly conveyed sheets of recording medium from being determined as jamming. The present invention, however, should not be limited to this. A control part or the like of the apparatus may be informed of the fact that the recording medium is not satisfactorily separated, the separation electrifier is in a state where the recording medium tends to jam, or the separation electrifier is dirty, so that a user or a service man can take proper measures.

(Second embodiment)

There will now be described a second embodiment of the present invention with reference to FIGS. 3–5.

An image forming apparatus provided with a recording medium conveyance apparatus of the present embodiment has the same basic construction as the prior art in FIGS. 8–10, and thus, FIGS. 8–10 will be used to explain the second embodiment if necessary. FIG. 12 showing the prior art is used to explain the relationship between the frequency of passage of the recording medium through a post-separation sensor and passage timing. Moreover, the basic construction of the control system is the same as that of the first embodiment in FIG. 1, and thus, FIG. 1 will be used to explain the control system.

In the image forming apparatus in which an image formed on an photosensitive drum (801 in FIG. 8, 903 in FIG. 9 and 1006 in FIG. 10) as an image carrier is transferred onto a recording medium (P in FIG. 8 and 906 in FIG. 9) by a transfer part (805 in FIG. 8), a timing calculating means 102 calculates the passage timing of the recording medium according to a sensor signal 101 from a post-separation sensor (807 in FIG. 8, 905 in FIG. 9 and 1004 in FIG. 10), and a timing storing means 103 stores the calculated passage timing for a predetermined number (n) of sheets of recording medium. A percentage calculating means (mean value calculating means 104) calculates a percentage (probability) k with which passage timing t in which a predetermined number of sheets of recording medium conveyed from a control unit 105 pass the post-separation sensor lies outside a range of between a predetermined value I and m, i.e., I<t<m. The values I and m are set to such values that a mean value of the measured timing for a predetermined number of sheets of recording medium when a small number of sheets of recording medium are conveyed is between I and m (see FIG. 3). The calculation of the percentage k with which the passage timing t lies outside the range of I<t<m, makes it possible to find the deterioration in the recording medium separation performance.

Figure 3:
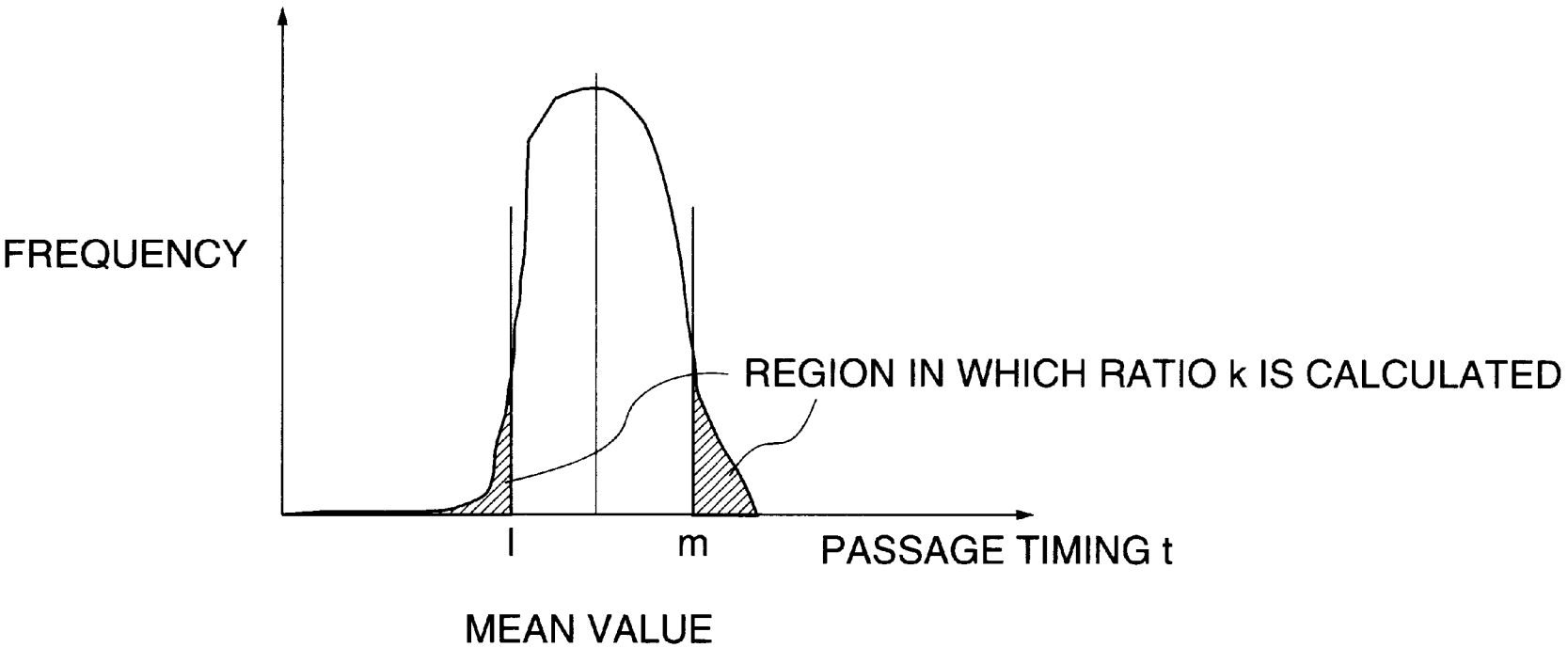
FIG. 3 is a graph showing a percentage of the frequency of passage of a recording medium in timing other than predetermined timing in a recording medium conveyance apparatus according to a second embodiment of the present invention.

FIG. 3 is a graph in which the ordinate represents the frequency of passage (the number of passing sheets of recording medium) and the abscissa represents the passage timing. Regions in which the percentage k is calculated are hatched in FIG. 3.

If the percentage k with which the passage timing t lies outside the range of I<t<m is larger than a predetermined value R, the jam detection timing Tjam is delayed by a predetermined period of time S. This restrains the occurrence of the jam because the jam detection timing Tjam is delayed by the predetermined period of time S when the recording medium separation performance deteriorates to increase the possibility of jamming.

The operation of the recording medium conveyance apparatus will be described below, provided that the predetermined number of sheets of recording medium n is 0, the value l is (the mean value of t for initial 500 sheets of the recording medium passing the post separation sensor−three times the standard deviation) (mean value−3 σ), the value m is (the mean value of t for initial 500 sheets of the recording medium passing the post separation sensor+three times the standard deviation (mean value+3 σ), the predetermined value R is 5%, and the predetermined period of time S is 5 ms.

That is, the passage timing t of initial five hundred sheets of the recording medium passing the post-separation sensor is measured and stored to calculate the mean value. Then, the percentage k with which the passage timing t lies outside the range of (mean value−3 σ<passage timing<mean value+3 σ) is calculated every five hundred sheets of recording medium.

If the calculated percentage k with which the passage timing lies outside the range of (mean value−3 σ<passage timing<mean value+3 σ) is less than 5%, no special action is taken. If the calculated percentage k exceeds 5%, however, the jam detection timing Tjam is delayed by 5 ms.

An explanation will now be given of the reason for calculating the percentage k with which the passage timing t lies outside the range of (mean value−3 σ<passage timing<mean value+3 σ). If the recording medium separation performance is normal, it is known that the distribution of the passage timing is normal and the percentage k with which the passage timing lies outside the range of (mean value−3 σ<passage timing<mean value+3 σ) is about 0.3% in a graph in that the ordinate represents the frequency of passage (the number of passing sheets of recording medium) and the abscissa represents the passage timing. If, however, the recording medium separation performance becomes insufficient and the passage timing varies widely due to the dirt of the separation electrifier or the like, the percentage k with which the passage timing lies outside the range of (mean value−3 σ<passage timing<mean value+3 σ) is increased. The use of the percentage k as an index makes it possible to effectively detect the poor separation of the recording medium.

Figure 4:
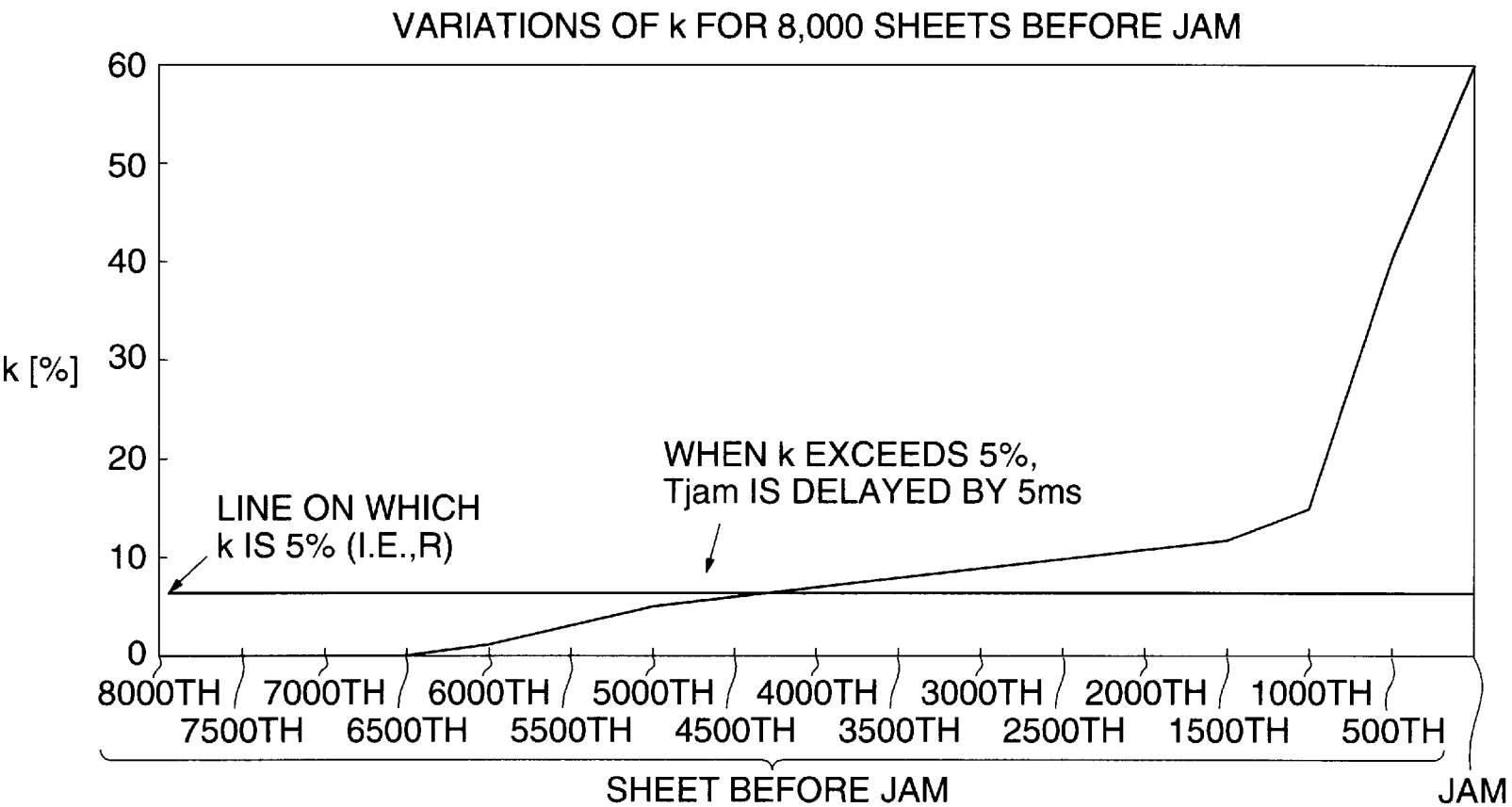
FIG. 4 is a graph showing a behavior of the frequency of passage of the recording medium in timing other than predetermined timing in which a jam can occur in the recording medium conveyance apparatus according to the second embodiment.
Figure 5:
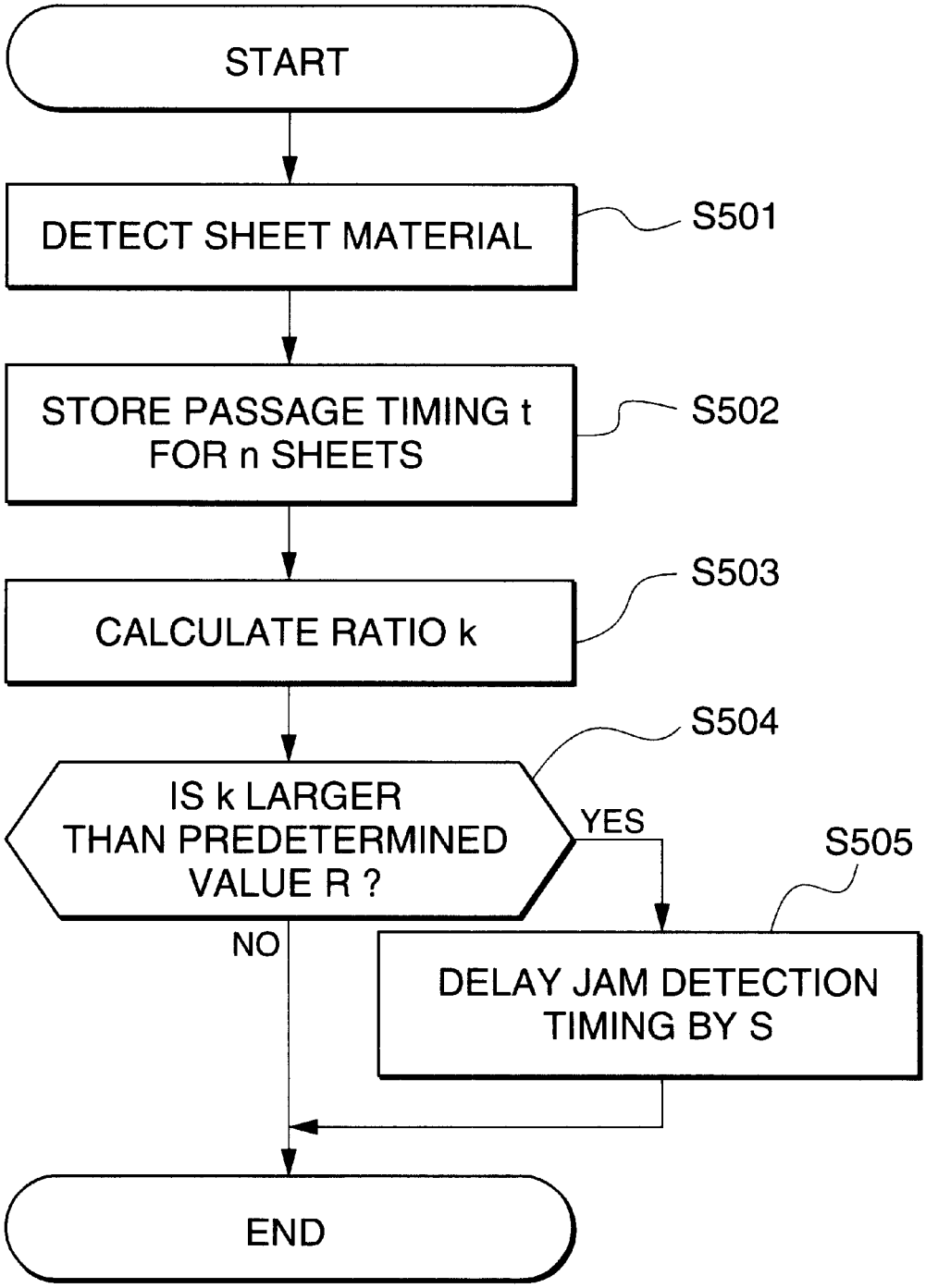
FIG. 5 is a flow chart showing a flow of operation of a control system in the recording medium conveyance apparatus according to the second embodiment.

FIG. 4 shows a behavior or variations of the percentage k for 8,000 sheets of recording medium before the occurrence of a jam. In FIG. 4, the left end indicates the percentage k for a 8,000th sheet of recording medium before the jam, and the right end indicates the percentage k when the jam occurs (the value I is (mean value for initial passing 500 sheets of the recording medium−3 σ), and the value m is (the mean value+3 σ). If the predetermined value R is 5%, the percentage k exceeds 5% when a 5,000th sheet of the recording medium passes the post-separation sensor before the jam. At this time, the jam detection timing Tjam is delayed by 5 ms to prevent the occurrence of the jam at the right end.

There will now be described the procedure for changing the jam detection timing Tjam by the recording medium conveyance apparatus that is constructed in the above described manner, with reference to a flow chart of FIG. 5.

After the start of the copying operation of the image forming apparatus, the recording medium fed to a feeding roller (804 in FIG. 8) is stopped at a pair of resist rollers (809 in FIG. 8 and 1005 in FIG. 10) to be corrected from oblique movement thereof. In a next step S501, the resist clutch is turned on so that a post-separation sensor (807 in FIG. 8, 905 in FIG. 19 and 1004 in FIG. 10) detects the separation of the recording medium (sheet material) from an image carrier (801 in FIG. 8, 901 in FIG. 9 and 1001 in FIG. 10). The recording medium then passes through a fixing part (806 in FIG. 8) and is discharged to the outside of the apparatus.

In a next step S502, the timing measuring means 102 calculates the passage timing t after the resist clutch is turned on and until the recording medium passes the post-separation sensor. The timing storing means 103 then stores the calculated passage timing. The percentage calculating means (mean value calculating means 104) calculates the percentage k with which the passage timing t lies outside the range defined by the predetermined values I and m, for every predetermined number of sheets of recording medium. In a next step S504, the control unit 105 determines whether the percentage k calculated in the step S503 is larger than the predetermined value R. If the percentage k is determined as being less than the predetermined value R, the process is finished. That is, the control unit 105 that controls the jam detection timing Tjam does not operate so that the jam timing is unchanged.

On the other hand, with an increase in the number of conveyed sheets of recording medium, the percentage k increases, which finally becomes larger than the predetermined value R. If the percentage k is determined as being larger than the predetermined value R in the step S504, the percentage calculating means (mean value calculating means 104) transmits a signal to the control unit 105 in a step S505. Responsive to the signal, the control unit 105 delays the jam detection timing Tjam by the predetermined period of time S, and the process is then finished.

Thus, the delay jam can be prevented by storing the passage timing t, calculating the percentage k with which the passage timing t for a predetermined number of sheets of recording medium lies outside the range defined by the predetermined values l and m, and delaying the jam detection timing Tjam by the predetermined period of time S if the percentage k is larger than the predetermined value R.

If the percentage k repeatedly becomes larger than the predetermined R, the jam detection timing may be delayed infinitely. This may result in damage to a part or parts in the image forming apparatus. To solve this problem, information indicating the abnormality is displayed on a display means when the jam detection timing Tjam exceeds a preset maximum jam detection timing Tbreak.

(Third embodiment)

There will now be described a third embodiment of the present invention with reference to FIGS. 6 and 7.

An image forming apparatus provided with a recording medium conveyance apparatus of the present embodiment has the same basic construction as the prior art in FIGS. 8–10, and thus, FIGS. 8–10 will be used to explain the third embodiment if necessary. FIG. 12 showing the prior art will be used to explain the relationship between the frequency of passage of the recording medium through a post-separation sensor and passage timing.

In the image forming apparatus of the present embodiment, a transfer part (805 in FIG. 8) transfers an image formed on a photosensitive drum (801 in FIG. 8, 903 in FIG. 9 and 1006 in FIG. 10) as an image carrier onto a recording medium (P in FIG. 8 and 906 in FIG. 9) and the application of an electric current to an electrifier at a recording medium separating part separates the recording medium and the image from the photosensitive drum. The image forming apparatus has a post-separation sensor (807 in FIG. 8, 905 in FIG. 9 and 1004 in FIG. 10) arranged behind the recording medium separating part, measures passage timing of the recording medium passing the post-separation sensor, calculates a mean value of the measured timing(Tmean 602 in FIG. 6) for an initial predetermined number (e.g., 500) of sheets of recording medium passing the post-separation sensor, and thereafter calculates a mean value of the measured timing (Tmean' 601 in FIG. 6) for every predetermined number of sheets of recording medium. If the mean value Tmean' is delayed from the mean value Tmean by a predetermined period of time (e.g., 5 ms) or is delayed from the same by a predetermined percentage (e.g., 10%), a current value applied to the separation electrifier is changed.

Figure 6:
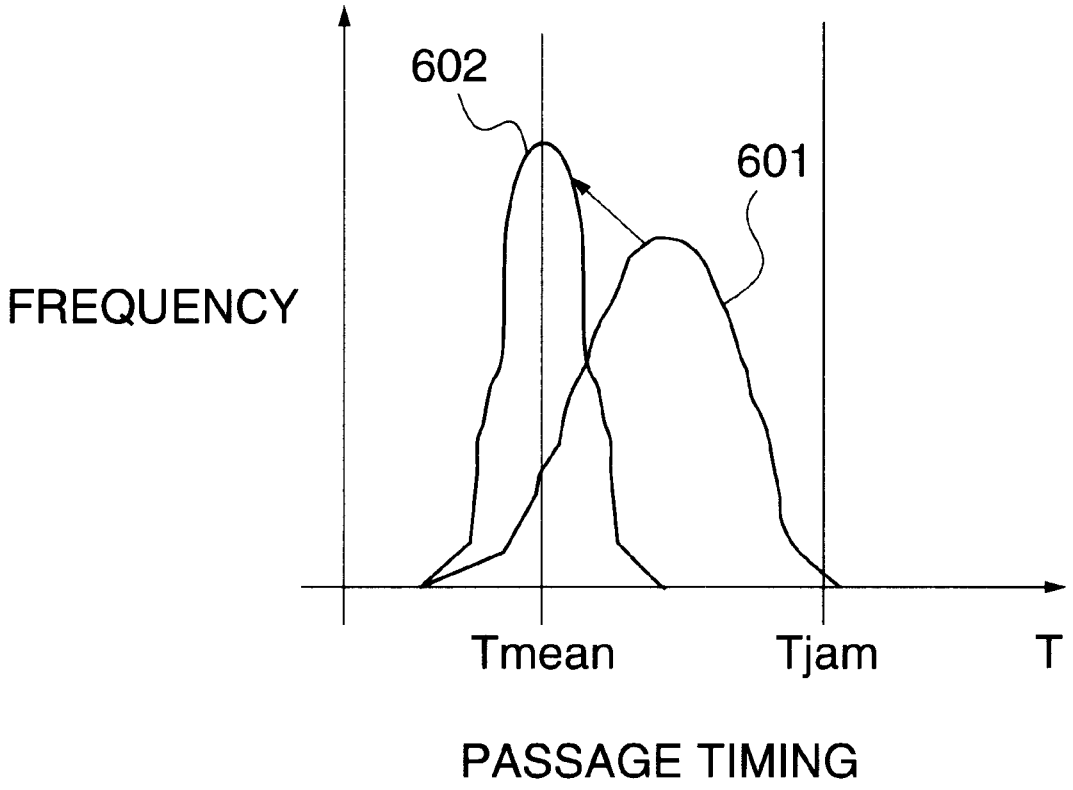
FIG. 6 is a graph showing the distribution of the number of passing sheets of recording medium (the frequency of passages) when a current value applied to a separation electrifier is varied in a recording medium conveyance apparatus according to a third embodiment of the present invention.

FIG. 6 is a graph showing the present embodiment. In the graph, the ordinate represents the frequency of passage (the number of passing sheets of recording medium) and the abscissa represents passage timing. As is clear from the graph, it is known that the passage of a large number of sheets of recording medium causes a delay in the passage timing as indicated by a line 601 in FIG. 6. By changing the current value applied to the separation electrifier to an optimum value, the passage timing is expected to be distributed in good order as indicated by a line 602 in FIG. 6.

If the image carrier is a photosensitive drum and the separation electrifier is a corona electrifier, only a value of a direct current is changed since it is known that a change in a peak alternating current results in leakage.

If the photosensitive drum is formed of amorphous silicon, the current value of the separation electrifier is changed to a reduced value by a set amount (e.g., −10 mA) since a change in the current value to a minus side makes the recording medium tend to separate from the photosensitive drum.

If the photosensitive drum is formed of OPC (organic Photo Conductor), the current value of the separation electrifier is changed to an increased value by a set amount (e.g., +10 mA) since a change in the current value to a plus side makes the recording medium tend to separate from the photosensitive drum.

Irrespective of whether the photosensitive drum is formed of amorphous silicon or OPC, it can be considered that a great change in the mean value of the passage timing with a tendency to delay is significantly larger than the set value of the separation electrifier by which the current value is changed. In this case, the change in the current of the separation electrifier is determined (e.g., at ±50 mA) at the designing stage since there may be a leakage or an image may not be satisfactorily put on the recording medium.

Figure 7:
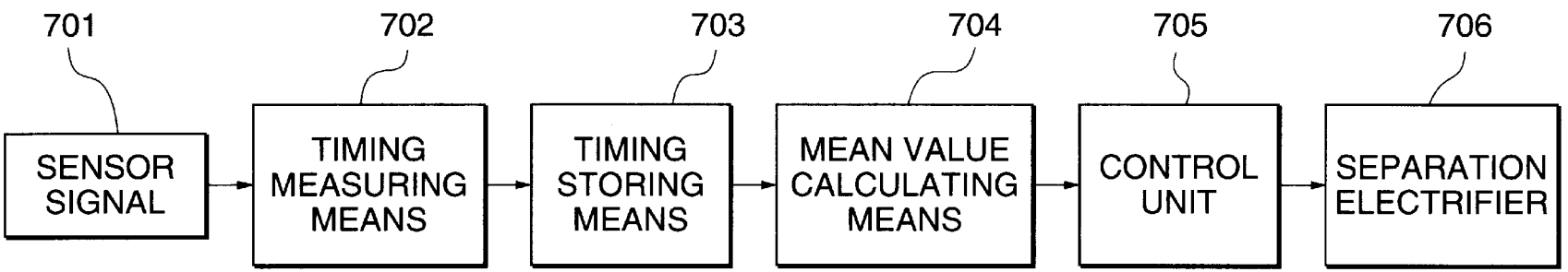
FIG. 7 is a block diagram showing the construction of a control system in the recording medium conveyance apparatus according to the third embodiment of the present invention.

FIG. 7 is a block diagram showing the construction of a control system in the recording medium conveyance system according to the present embodiment. In FIG. 7, reference numeral 701 denotes a sensor signal, which is generated from the post-separation sensor. Reference numeral 702 denotes a timing measuring means, which measures sensor signal generation timing according to the sensor signal 701. Reference numeral 703 denotes a timing storing means, which stores the sensor signal generation timing measured by the timing measuring means 702. Reference numeral 704 denotes a mean value calculating means, which calculates a mean value of the measured timing for every predetermined number of sheets of recording medium. Reference numeral 705 denotes a control unit, which controls the entire control system. Reference numeral 707 denotes a separation electrifier, which separates the recording medium from the photosensitive drum.

In the control system that is constructed in the above described manner, the timing measuring means 702 measures the sensor signal generation timing according to the sensor signal 701, the timing storing means 703 stores the measured sensor signal generation timing, the mean value calculating means calculates a mean value of the measured timing for every predetermined number of sheets of recording medium, the control unit 705 determines whether there has been a predetermined change from the initial mean value and changes the current value applied to the separation electrifier 706 if there has been the predetermined change.

According to the present embodiment, the reference signal is not limited to be only the mean value but also the standard deviation σ, the maximum value Tmax, the minimum Tmin, or a combination thereof or the like. If a change in the reference signal is detected, the current value applied to the separation electrifier 706 may be controlled to change by the control unit 705.

In addition to or alternatively to the change of the current value, the control operation may be cleaning of the separation electrifier 706. That is, if there is a change in the reference signal, the separation electrifier 706 may be cleaned.

According to the recording medium conveyance method and apparatus of the present embodiment as described above, the change of the jam detection timing prevents a part of sheets of recording medium conventionally considered to be properly conveyed, which pass the post-separation sensor after the jam detection timing, from being determined as jamming. Moreover, the recording medium conveyance method and apparatus of the present embodiment enable quick alert of an abnormality in the body of the apparatus by warning a user of a change in the result of the statistic calculation of the passage timing. If there is a change in the result of the statistic calculation of the passage timing, the jam and poor separation of the recording medium can be decreased by changing the current value applied to the separation electrifier. Moreover, if there is a change in the result of the statistic calculation of the passage timing, the jam and poor separation of the recording medium can be decreased by cleaning the separation electrifier.

Of course, the present invention may be implemented by supplying a system or an apparatus with a storage medium in which a program code of software which realizes the functions of any of the above described embodiments is stored, and causing a computer (or CPU or MPU) of the system or apparatus to read out and execute the program code stored in the storage medium.

In this case, the program code read out from the storage medium realizes the functions of any of the above described embodiments, so that the storage medium storing the program code also constitutes the present invention.

The storage medium for supplying the program code may be, for example, a floppy disk, a hard disk, an optical disk, a magneto-optical disk, a CD-ROM, a CD-R, a magnetic tape, a non-volatile memory card, or a ROM.

Further, it is to be understood that the functions of the above described embodiments may be accomplished not only by executing a program code read out by a computer, but also by causing an OS (Operating System) or the like which operates on the computer to perform a part or the whole of the actual operations based on instructions of the program code.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

transfer means for transferring a toner image carried on an image carrier, onto a recording medium;

separation means for separating said recording medium from said image carrier;

detection means for detecting said recording medium separated by said separation means;

measuring means for measuring a passage timing in which said recording medium passes a predetermined location in accordance with a detection result of said detection means; and control means for controlling said separation means in accordance with a measuring result measured by said measuring means.

2. An image forming apparatus according to claim 1, wherein said control means controls an electric current applied to said separation means.

3. An image forming apparatus according to claim 1, further comprising storage means for storing timing in which said recording medium is detected by said detection means.

4. An image forming apparatus comprising:

transfer means for transferring a toner image carried on an image carrier, onto a recording medium;

separation means for separating said recording medium from said image carrier;

detection means for detecting said recording medium separated by said separation means;

measuring means for measuring a passage timing in which said recording medium passes a predetermined location in accordance with a detection result of said detection means; and cleaning means for cleaning said separation means in accordance with a measuring result measured by said measuring means.

5. An image forming apparatus according to claim 4, further comprising storage means for storing timing in which said recording medium is detected by said detection means.

6. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said statistic calculation step comprises calculating a standard deviation of the measured timing.

7. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said statistic calculation step comprises calculating maximum passage timing of said recording medium.

8. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said statistic calculation step comprises calculating minimum passage timing of said recording medium.

9. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said statistic calculation step comprises calculating percentage of frequency of passage of said recording medium through said predetermined location in timing other than predetermined timing.

10. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said statistic calculation step comprises calculating at least two of a mean value of the measured timing, a standard deviation of the measured timing, maximum passage timing of said recording medium, and minimum passage timing of said recording medium.

11. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step; and a control step of executing a control in such a manner as to perform a predetermined operation in accordance with the statistically calculated passage timing information acquired in said statistic calculation step, wherein said control step comprises giving a warning of a change in the statistically calculated passage timing information.

12. A recording medium conveyance method for conveying a recording medium, comprising:

a recording medium separation step of separating a moving recording medium in contact with a member on said recording medium, from said member;

a recording medium detecting step of detecting said recording medium at a predetermined location downstream of said recording medium separation step;

a timing measuring step of measuring timing in which said recording medium passes the predetermined location downstream of said recording medium separation step in accordance with passage timing information acquired in said recording medium detecting step;

a passage timing storing step of storing the passage timing information acquired in said timing measuring step;

a statistic calculation step of executing a statistic calculation to acquire statistically calculated passage timing information in accordance with the passage timing information stored in said passage timing storing step;

a control step of executing a control in such a manner as to perform a predetermined operation in accordance with the statistically calculated passage timing information acquired in said statistic calculation step;

a separation electrifying member cleaning step of cleaning a separation electrifying member for use in said recording medium separation step; and a second control step of controlling said separation electrifying member cleaning step in accordance with the statistically calculated passage timing information acquired in said statistic calculation step.

13. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said statistic calculation means calculates a standard deviation of the measured timing.

14. A recording medium conveyance apparatus according to claim 13, wherein said control means comprises means for controlling timing of detecting a jam of said recording medium.

15. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said statistic calculation means calculates maximum passage timing of said recording medium.

16. A recording medium conveyance apparatus according to claim 15, wherein said control means comprises means for controlling timing of detecting a jam of said recording medium.

17. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said statistic calculation means calculates minimum passage timing of said recording medium.

18. A recording medium conveyance apparatus according to claim 17, wherein said control means comprises means for controlling timing of detecting a jam of said recording medium.

19. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said statistic calculation means calculates percentage of frequency of passage of said recording medium through said predetermined location in timing other than predetermined timing.

20. A recording medium conveyance apparatus according to claim 19, wherein said control means comprises means for controlling timing of detecting a jam of said recording medium.

21. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said statistic calculation means calculates at least two of a mean value of the measured timing, a standard deviation of the measured timing, maximum passage timing of said recording medium, and minimum passage timing of said recording medium.

22. A recording medium conveyance apparatus according to claim 21, wherein said control means comprises means for controlling timing of detecting a jam of said recording medium.

23. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means; and control means for executing a control in such a manner as to perform a predetermined operation in accordance with the statistically calculated passage timing information acquired by said statistic calculation means, wherein said control means comprises means for giving a warning of a change in the statistically calculated passage timing information.

24. A recording medium conveyance apparatus according to claim 23, wherein said control means comprises means for controlling timing of detecting a jam of said recording medium.

25. A recording medium conveyance apparatus for conveying a recording medium, comprising:

recording medium separation means for separating a moving recording medium in contact with a member on said recording medium, from said member;

recording medium detecting means for detecting said recording medium at a predetermined location downstream of said recording medium separation means;

timing measuring means for measuring timing in which said recording medium passes the predetermined location downstream of said recording medium separation means in accordance with passage timing information acquired by said recording medium detecting means;

passage timing storing means for storing the passage timing information acquired by said timing measuring means;

statistic calculation means for executing a statistic calculation to acquire statistically calculated passage timing information in accordance with the passage timing information stored by said passage timing storing means;

control means for executing a control in such a manner as to perform a predetermined operation in accordance with the statistically calculated passage timing information acquired by said statistic calculation means;

separation electrifying member cleaning means for cleaning a separation electrifying member used for said recording medium separation means; and second control means for controlling said separation electrifying member cleaning means in accordance with the statistically calculated passage timing information acquired by said statistic calculation means.

26. A recording medium conveyance apparatus according to claim 25, wherein said control means comprises means for controlling timing of detecting a jam of said recording medium.

27. A recording medium conveyance apparatus for conveying a recording medium, comprising:

a feeder for feeding a recording medium to an image carrier;

a separator for separating the recording medium from said image carrier;

a detector for detecting the recording medium at a predetermined location downstream of said separator;

a discriminator for discriminating a jam of the recording medium in accordance with a detecting result of said detector at a jam detection timing;

a measurer for measuring a passage timing in which said recording medium passes the predetermined location in accordance with a detection result of said detector; and a changer for changing said jam detection timing at the predetermined location in accordance with said passage timing measured by said measurer at the predetermined location.

28. A recording medium conveyance apparatus according to claim 27, wherein said changer delays the jam detection timing by a predetermined time period in accordance with the measuring result.

29. A recording medium conveyance apparatus according to claim 28, further comprising an alarm for alarming when the jam detection timing delayed by said changer would be larger than a maximum jam detection timing.

30. A recording medium conveyance apparatus according to claim 27, wherein said changer calculates a mean value of the measuring result for an arbitrary number of recording medium and changes the jam detection timing in accordance with the mean value.

31. A recording medium conveyance apparatus according to claim 30, wherein said changer stores a initial mean value of the measuring result for an initial arbitrary number of recording medium and compares the initial mean value and a mean value of the measuring result for the arbitrary number of recording medium and changes the jam detection timing when a difference between the initial mean value and the mean value.

32. An image forming apparatus comprising:

a transferor for transferring a toner image carried on an image carrier, onto a recording medium;

a separator for separating said recording medium from said image carrier;

a detector for detecting said recording medium separated by said separator;

a measurer for measuring a passage timing in which said recording medium passes a predetermined location in accordance with a detection result of said detector; and a controller for controlling said separator in accordance with a measuring result measured by said measurer.

33. An image forming apparatus comprising:

a transferor for transferring a toner image carried on an image carrier, onto a recording medium;

a separator for separating said recording medium from said image carrier;

a detector for detecting said recording medium separated by said separator;

a measurer for measuring a passage timing in which said recording medium passes a predetermined location in accordance with a detection result of said detector; and a cleaner for cleaning said separator in accordance with a measuring result measured by said measurer.

* * * * *